US005683277A

United States Patent [19]

Tsunoda et al.

[11] Patent Number: 5,683,277

[45] Date of Patent: Nov. 4, 1997

[54] INTAKE DEVICE IN ENGINE FOR OUTBOARD ENGINE SYSTEM

[75] Inventors: Masaki Tsunoda; Kouji Koishikawa; Hitoshi Suzuki, all of Wako, Japan

[73] Assignee: Honda Giken Kogyo Kabushiki Kaisha, Tokyo, Japan

[21] Appl. No.: 645,769

[22] Filed: May 14, 1996

[30] Foreign Application Priority Data

May 18, 1995 [JP] Japan ..... 7-120212

[51] Int. Cl.[6] ..... B63H 21/10

[52] U.S. Cl. ..... 440/88; 440/900; 181/229; 181/243; 123/198 E; 123/195 P

[58] Field of Search ..... 440/77, 88, 89, 440/900; 123/214, 229, 243, 195 C, 195 E, 194 P, 198 E, 196 W

[56] References Cited

U.S. PATENT DOCUMENTS 4,846,300 7/1989 Boda ..... 440/88

5,035,211 7/1991 Mate et al. ..... 181/243

5,083,538 1/1992 Hubbell ..... 181/229

FOREIGN PATENT DOCUMENTS 406122396 5/1994 Japan ..... 440/88

6-264757 9/1994 Japan .

*Primary Examiner*—Edwin L. Swinehart

*Attorney, Agent, or Firm*—Nikaido, Marmelstein, Murray & Oram LLP

[57] ABSTRACT

A V-shaped multi-cylinder engine is mounted in such a manner that a crankshaft is mounted in a vertical attitude and cylinders are opened into a V-shape in a rearward direction. An intake silencer is mounted above a throttle body which is disposed in front of a crankcase portion of the engine. The intake silencer includes an intake silencing chamber defined by a belt cover which covers a belt of a valve operating mechanism and by a lower wall member. Two left and right air intake pipes extend downwardly from the intake silencing chamber and open into an engine compartment. A single intake-air introducing pipe extends downwardly from the intake silencing chamber and is connected to an upper end of the throttle body. Thus, it is possible to reduce the intake noise of the engine for an outboard engine system.

14 Claims, 9 Drawing Sheets

INTAKE DEVICE IN ENGINE FOR OUTBOARD ENGINE SYSTEM

BACKGROUND OF THE INVENTION

1. Field of the Invention

The present invention relates to an intake device in an engine for an outboard engine system and includes an engine block subassembly for supporting a crankshaft in a vertical attitude. The engine block subassembly has a plurality of cylinders formed therein to extend rearwardly from the crankshaft. A cylinder head is coupled to a rear end of the engine block subassembly. A throttle body is disposed in front of the engine block subassembly. A plurality of intake pipes extend from the throttle body through left and right opposite sides of the engine block subassembly and are connected to the cylinder head.

2. Description of the Related Art

An engine for an outboard engine system is already known from Japanese Patent Application Laid-open No. 264757/94.

The above known engine is not provided with any special intake silencer. The known engine is designed such that air is drawn through an intake guide to a throttle body which is disposed in front of the engine block subassembly. Therefore, a problem in the known system is that an intake noise is generated during operation of the engine.

SUMMARY OF THE INVENTION

It is an object of the present invention to reduce the intake noise by rationally disposing the intake silencer in the engine for the outboard engine system.

According to a first aspect of the present invention, an intake device in an engine for an outboard engine system includes an engine block subassembly for supporting a crankshaft in a vertical attitude, and has a plurality of cylinders formed therein to extend rearwardly from the crankshaft. A cylinder head is coupled to a rear end of the engine block subassembly. A throttle body is disposed in front of the engine block subassembly. A plurality of intake pipes extend from the throttle body through left and right opposite sides of the engine block subassembly and are connected to the cylinder head. The intake device includes an intake silencer mounted above the throttle body. The intake silencer includes an intake-air introducing pipe extending upwardly from the throttle body, an intake silencing chamber into which an upper end of the intake-air introducing pipe opens, and an air intake pipe which opens at an upper end thereof into the intake silencing chamber and extends downwardly from the intake silencing chamber.

With the first aspect of the present invention, all of the air intake pipes and the intake-air introducing pipe extend downwardly from and substantially in parallel to the intake silencing chamber. Thus, the intake silencer is easily disposed in a compact manner in a narrow space. Moreover, it is possible to prevent water from entering the intake silencing chamber.

In addition to the first aspect, according to a second aspect of the invention, the intake device further includes a belt cover. The belt cover covers a driving pulley mounted at an upper end of the crankshaft which protrudes on an upper surface of the engine block subassembly. A follower pulley is mounted at an upper end of a camshaft which protrudes on an upper surface of the cylinder head. A belt is wound around the driving and follower pulleys. The intake silencing chamber has an upper wall formed by the belt cover.

With the second aspect of the present invention, the belt cover can also be used as the upper wall of the intake silencing chamber to reduce the number of parts or components.

In addition to the second aspect, according to a third aspect, the belt cover has an internal space which is divided into the intake silencing chamber and a belt chamber by a partition wall. A substantially front half of a periphery of the driving pulley is surrounded by the partition wall.

With the third aspect of the present invention, the intake silencing chamber can be extended toward the belt chamber so as to enlarge the volume to a maximum, thereby providing a further enhanced intake silencing effect.

In addition to the third aspect, according to a fourth aspect, the belt cover is divided into a first cover half forming an upper wall of the intake silencing chamber, and a second cover half forming an upper wall of the belt chamber.

With the fourth aspect of the present invention, both of the cover halves can separately be mounted and removed, thereby facilitating maintenance work.

In addition to the fourth aspect, according to a fifth aspect, the intake-air introducing pipe and the air intake pipe are integrally formed to a lower wall member which is coupled to a lower surface of the belt cover to form a lower wall of the intake silencing chamber.

With the fifth aspect of the present invention, it is possible to reduce the number of parts or components.

In addition to the fifth aspect, according to a sixth aspect, an upper end of the intake-air introducing pipe extends higher in elevation than a bottom surface of the intake silencing chamber, and the intake silencing chamber is formed at a bottom surface thereof with a drain hole.

With the sixth aspect of the present invention, even if water enters the intake silencing chamber through the air intake pipes, the water can be discharged through the drain hole without flowing through the intake-air introducing pipe into the throttle body.

In addition to the sixth aspect, according to a seventh aspect, a pair of air intake pipes are provided as the air intake pipe. The pair of air intake pipes are disposed on left and right opposite sides of the intake-air introducing pipe.

With the seventh aspect of the present invention, even if the sectional area of a flow path of each of the air intake pipes is set at a small value, a sufficient total sectional area of the flow paths can be assured. Moreover, the throttle body can easily be disposed on a centerline of the engine to form left and right intake systems which are substantially symmetrical.

In addition to the seventh aspect, according to an eighth aspect, a stretchable fastener is stretched between the intake silencer and the throttle body, and another stretchable fastener is stretched between the intake silencer and the engine block subassembly, in order to detachably support the intake silencer on the throttle body and the engine block subassembly.

With the eighth aspect of the present invention, the intake silencer can easily be mounted on and removed from the throttle body and the engine block subassembly.

The above and other objects, features and advantages of the invention will become apparent from the following detailed description of a preferred embodiment taken in conjunction with the accompanying drawings.

DESCRIPTION OF THE PREFERRED EMBODIMENT

The present invention will now be described by way of a preferred embodiment with reference to the accompanying drawings.

Figure 1:
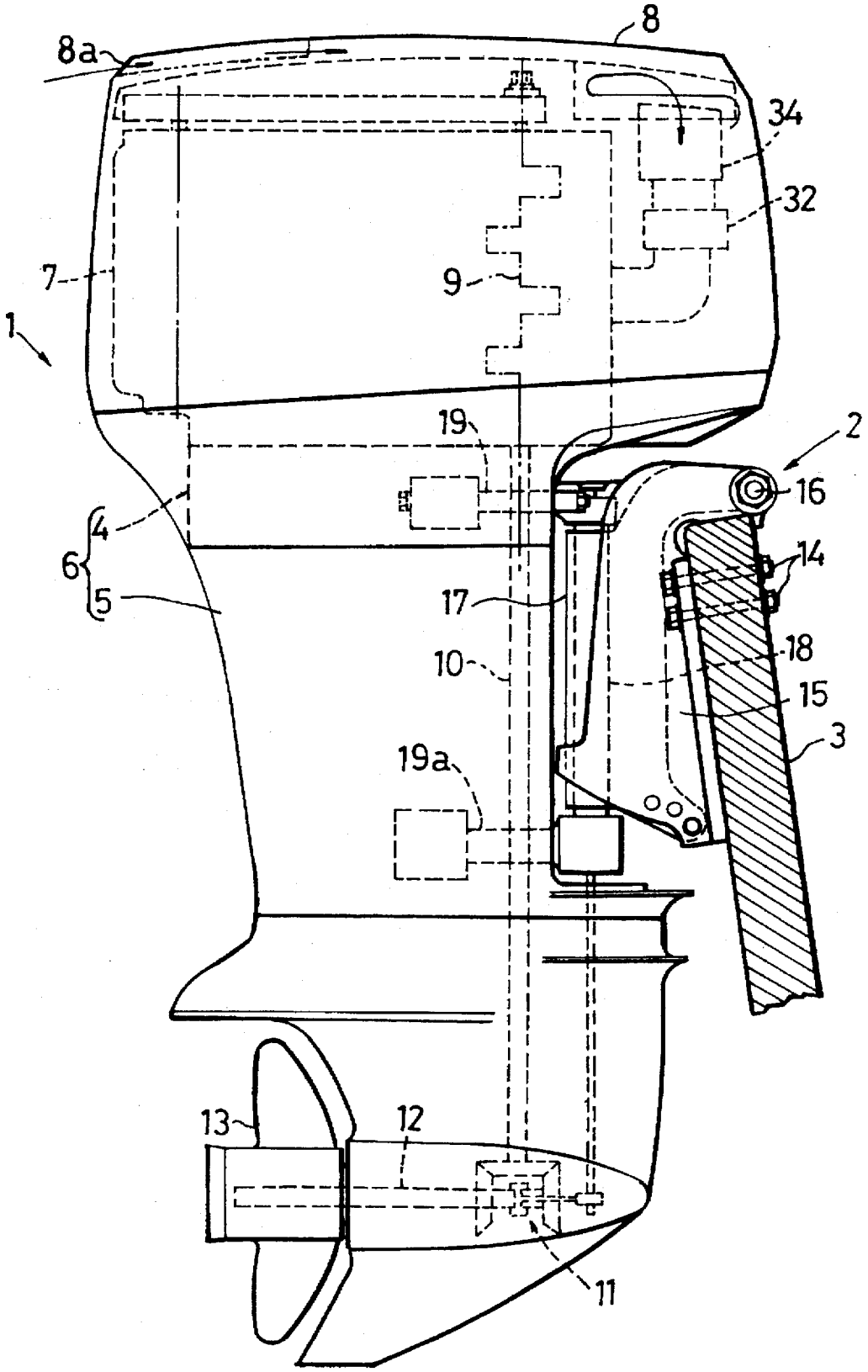
FIG. 1 is a side view of the entire arrangement of an outboard engine system.

FIG. 1 is a side view of the entire arrangement of an outboard engine system to which the present invention is applied. In FIG. 1, an outboard engine system body 1 is mounted to a stern 3 through a mounting device 2.

The engine system body 1 has an outboard engine system body case assembly 6 including an engine mount case 4 and an extension case 5. An engine 7 is mounted in an upper portion of the engine body case assembly 6. The engine 7 has a lower half which is covered with an under-cover case portion 6*a* which is connected to an upper end of the extension case 5. An upper half of the engine 7 is covered with an engine cover 8 which is detachably coupled to an upper edge of the under-case portion 6*a*. External air is introduced into the engine cover 8 through an air intake port 8*a*.

The engine 7 has a crankshaft 9 which is vertically directed. A driving shaft 10 is connected to the crankshaft 9 and extends downwardly within the engine system body case 6. The driving shaft 10 is connected at its lower end to a propeller shaft 12 through a forward and backward gear shift device 11. A propeller 13 is rotatively driven by engine power transmitted thereto via the crankshaft 9, the driving shaft 10, the forward and backward gear shift device 11 and the propeller shaft 12. The engine 7 will be described hereinafter in detail.

The mounting device 2 includes a pair of brackets 15 fixed to the stern 3 through bolts 14, and a swivel case 17 pivotally mounted to the bracket 15 through a tilting shaft 16 such that the swivel case 17 can be swung vertically. The tilting shaft 16 is mounted to a front end of the bracket 15 to extend laterally. A swivel shaft 18 is pivotally carried in a vertically directed attitude in the swivel case 17. The engine system body case assembly 6 is connected to the swivel shaft 18 through upper and lower connecting members 19 and 19*a*. Thus, the outboard engine system body case assembly 6 and thus the outboard engine system body 1 can be vertically swung about the tilting shaft 16 and can be leftwardly and rightwardly turned about an axis of the swivel shaft 18.

Figure 2:
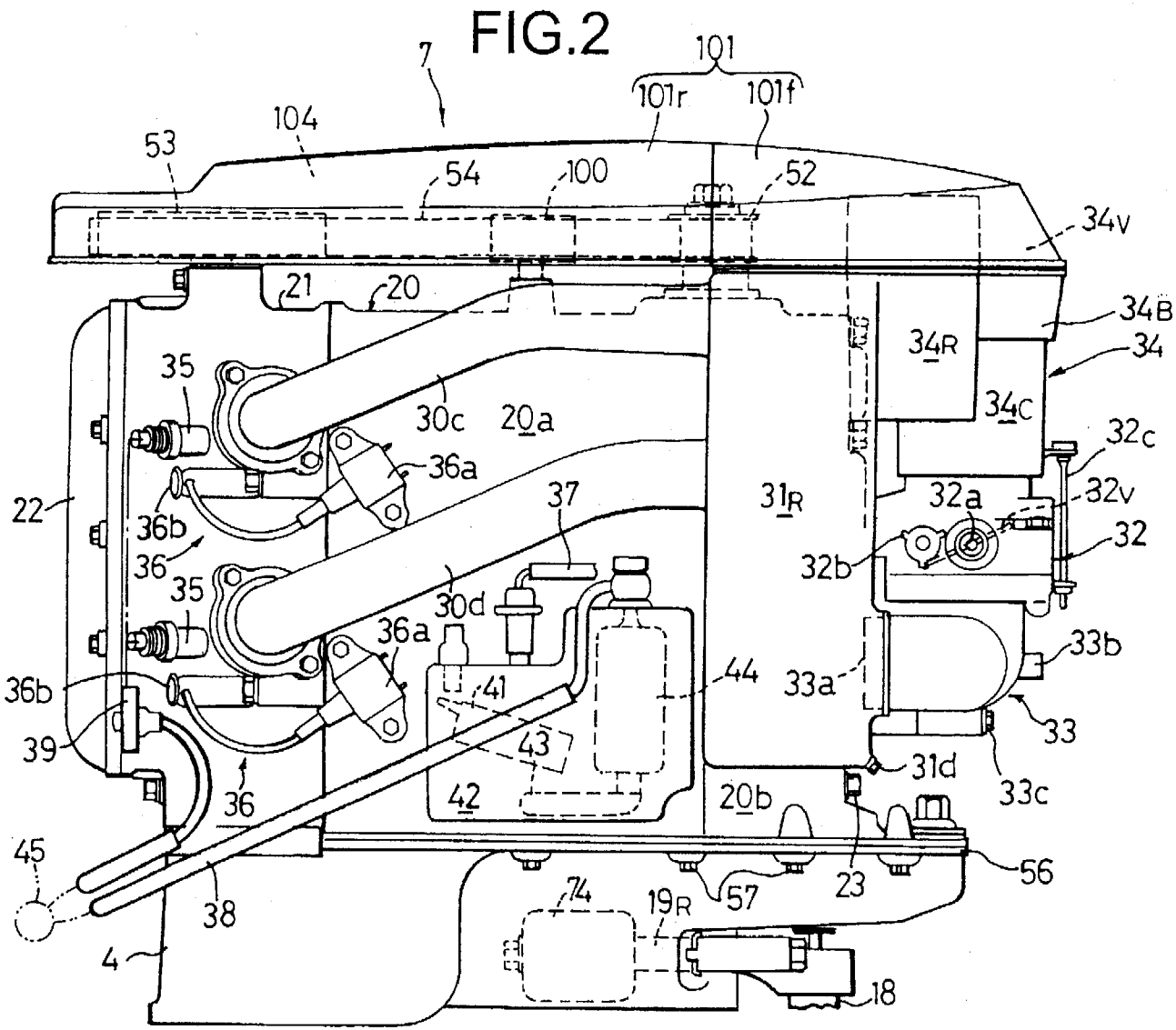
FIG. 2 is a right side view of an engine.
Figure 3:
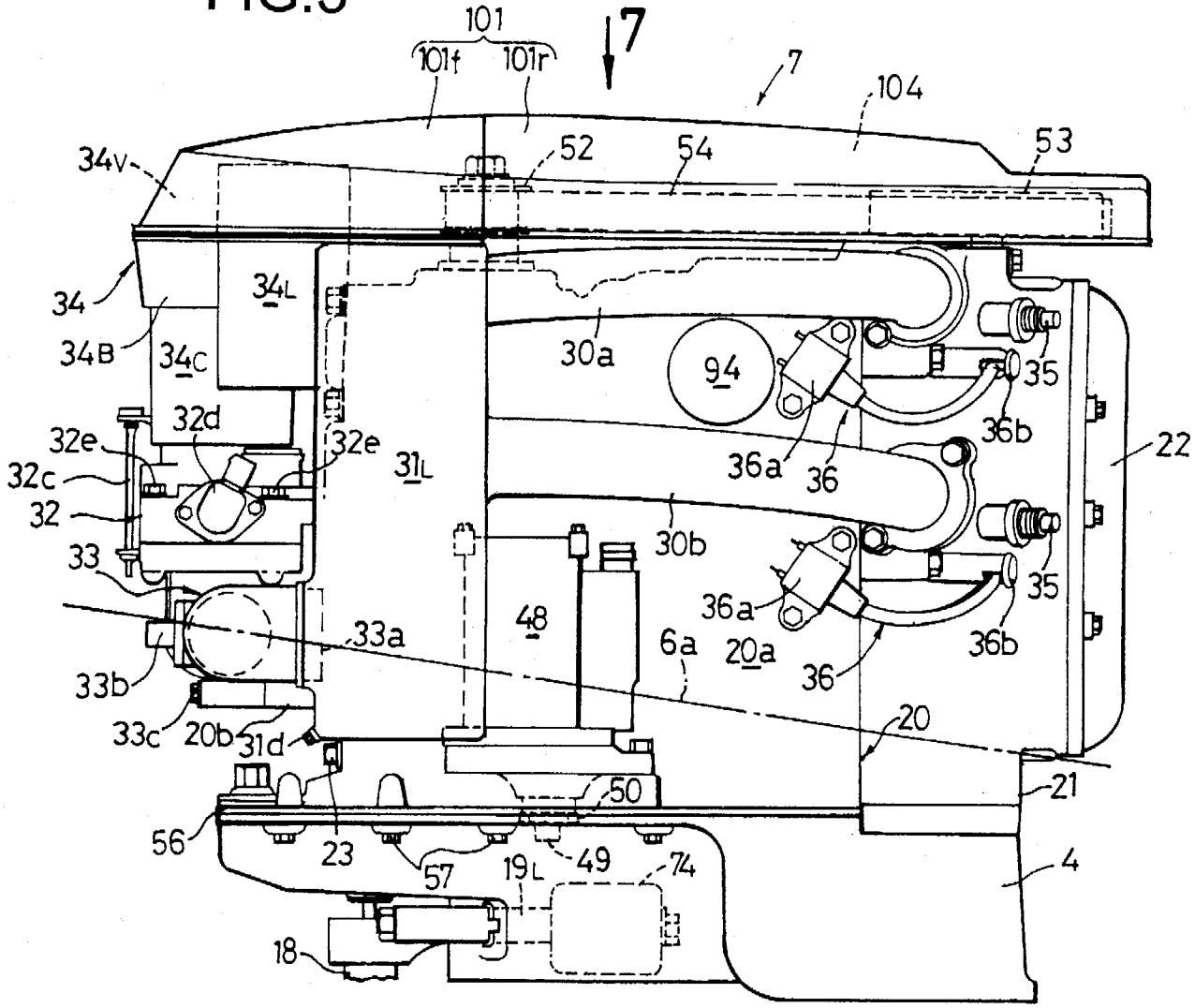
FIG. 3 is a left side view of the engine.
Figure 4:
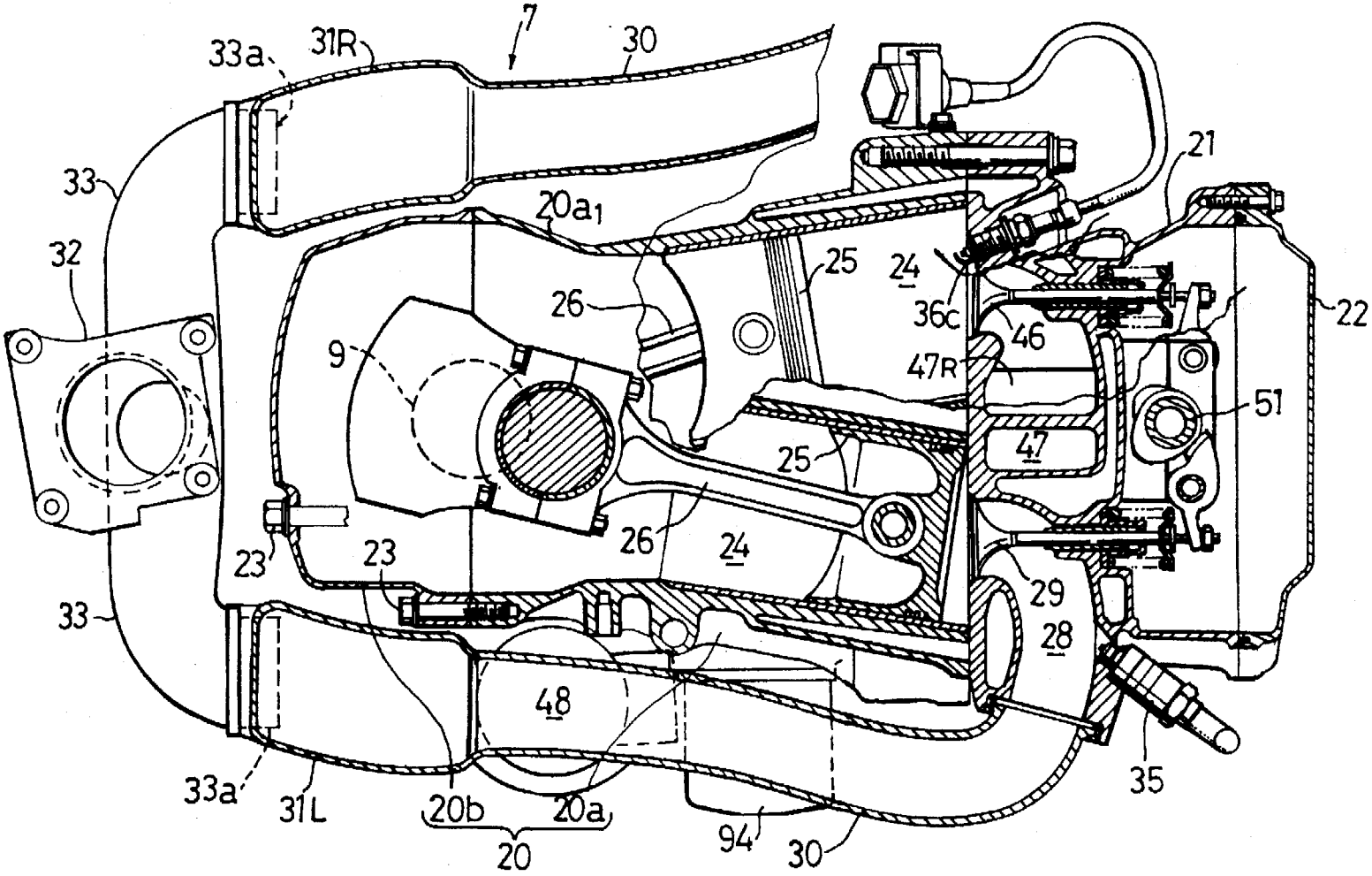
FIG. 4 is a transverse cross sectional view of the engine.

FIG. 2 is a right side view of the engine 7, FIG. 3 is a left side view of the engine 7, and FIG. 4 is a transverse cross sectional view of the engine 7. The term "left and right" of the engine or the outboard engine system refers to "left and right" as the outboard engine system mounted to the stern 3 in FIG. 1 is viewed forwardly from the rear (i.e., rightwardly from the left of FIG. 1).

A body of the engine 7 is composed of an engine block subassembly 20, a cylinder head 21, a cylinder head cover 22 and the like. The engine block subassembly 20 is formed by integrally fastening a cylinder block 20*a* integrally provided with a skirt portion 20*a*1 (see FIG. 4) forming a half of a crankcase chamber, to a remaining crankcase portion 20*b* by bolts 23. Two sets of pairs of cylinders 24, 24 are vertically disposed in a laterally V-shape within the engine block subassembly 20. That is, the engine 7 is a V-shaped 4-cylinder and 4-cycle engine, in which pistons 25 are connected to the single vertically directed crankshaft 9 through connecting rods 26.

Figure 5:
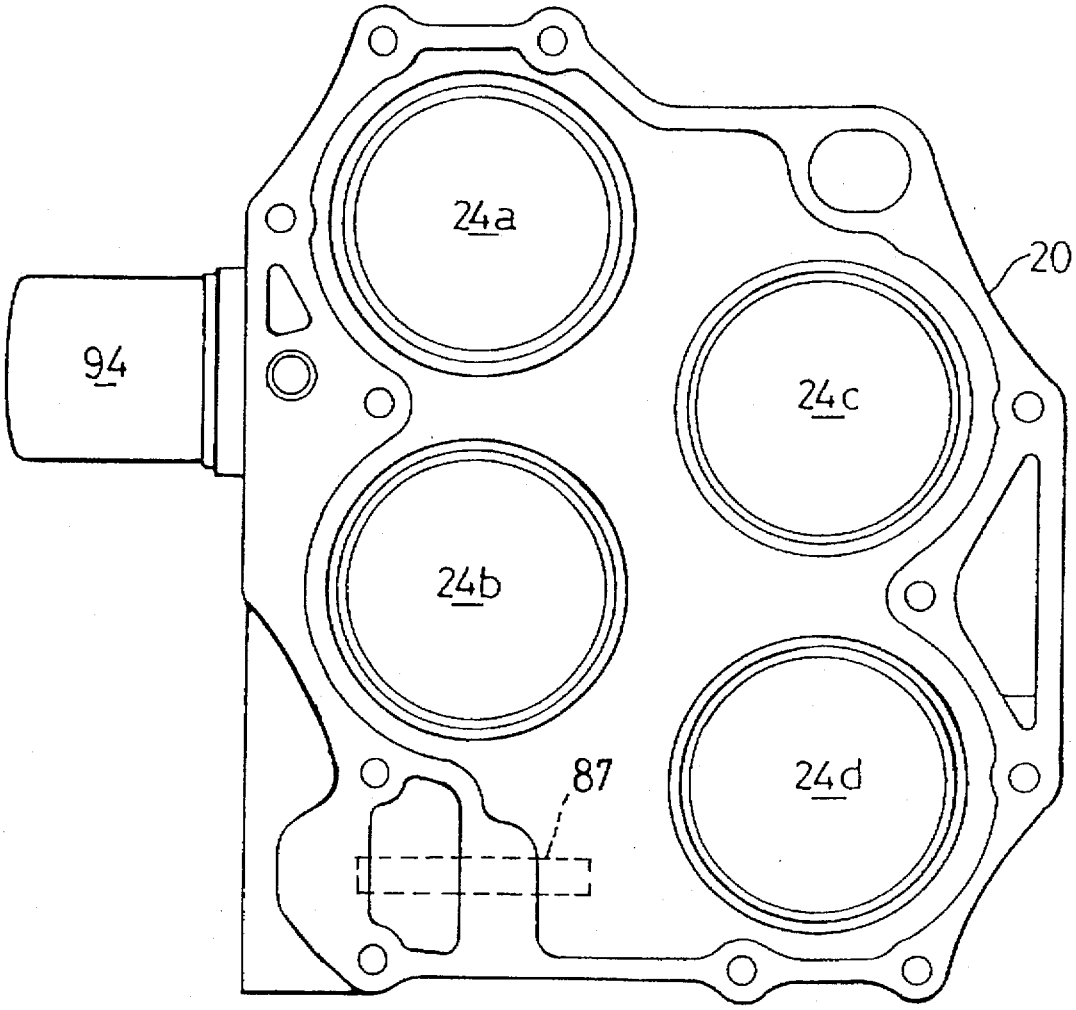
FIG. 5 is a view of an end of an engine block subassembly adjacent a cylinder head.

FIG. 5 is a view of an end of the engine block subassembly 20 adjacent the cylinder head 21. As can be seen from FIG. 5, the cylinders 24 are a set of upper and lower cylinders 24*a* and 24*b* arranged on a left side to accommodate a set of the upper and lower pistons 25, 25 and a set of connecting rods 26, 26 adjoining each other in an axial direction of the crankshaft 9. Another set of upper and lower cylinders 24*c* and 24*d* are arranged on a right side to accommodate another set of the upper and lower pistons 25, 25 and another set of connecting rods 26, 26 adjoining each other in the axial direction of the crankshaft 9. Thus, the two sets of cylinders are developed into the V-shape in a rearward direction and arranged in a zigzag manner with the left cylinders 24*a* and 24*b* located at elevation levels higher than those of the right cylinders 24*c* and 24*d*. Such an arrangement of the cylinders ensures that the lateral width of the engine block subassembly 20 can be decreased to reduce the size of the engine 7, as compared with other V-shaped engines.

FIG. 4 shows the cylinder 24 disposed on the left side of the outboard engine system (i.e., on a lower side in FIG. 4). As shown in FIG. 4, intake passages 28 are provided in the cylinder head 21 in correspondence to the cylinders 24. The intake passages 28 lead to the corresponding cylinders 24 through intake valves 29 and open at their other ends into a side of the cylinder head 21. An intake pipe 30 is connected to each of the openings of the intake passages 28 and extends along a side of the engine block subassembly 20 toward a crank chamber positioned ahead of the intake pipe 30. The intake pipes 30*c* and 30*d* shown in FIG. 2 are intake pipes corresponding to the cylinders 24*c* and 24*d* shown in FIG. 5, while the intake pipes 30*a* and 30*b* shown in FIG. 3 are intake pipes corresponding to the cylinders 24*a* and 24*b* shown in FIG. 5.

Surge tanks 31L and 31R are mounted on left and right opposite sides of a front portion of the engine block subassembly 20. The intake pipes 30*a* and 30*b* communicate with the surge tank 31L, while the intake pipes 30*c* and 30*d* communicate with the surge tank 31R. A throttle body 32, having a throttle valve 32V therein, is disposed at a front and substantially laterally central portion of the engine block subassembly 20. The throttle body 32 and the surge tanks 31L and 31R communicate with each other through an elbow which is in the form of air passages 33 which laterally diverge from the throttle body 32. Air is introduced from above into the throttle body 32 via an intake silencer 34 which includes left and right air intake pipes 34L and 34R, an intake silencing chamber 34V and a central intake-air introducing pipe 34C.

The left and right air passages 33, 33 are shaped laterally symmetrical and hence, the lengths of the air passages 33, 33 from the throttle body 32 to the surge tanks 31L and 31R are set to be substantially equal to each other. The left and right surge tanks 31L and 31R are also disposed at laterally symmetric locations on opposite sides of the engine block subassembly 20. Therefore, the length of each of the two left intake pipes 30*a* and 30*b* and the length of each of the two right intake pipes 30c and 30d are set to be substantially equal to each other.

The air introduced from above through the intake-air introducing pipe 34C is controlled in flow rate within the throttle body 32, and is then dispensed to the left and right surge tanks 31L and 31R and supplied as a burning air from the surge tanks 31L and 31R through the intake pipes 30a, 30b, 30c and 30d into the respective cylinders 24, while fuel is injected from fuel injecting valves 35 and mixed with the air in the intake ports 28 (see FIG. 4).

Figure 8:
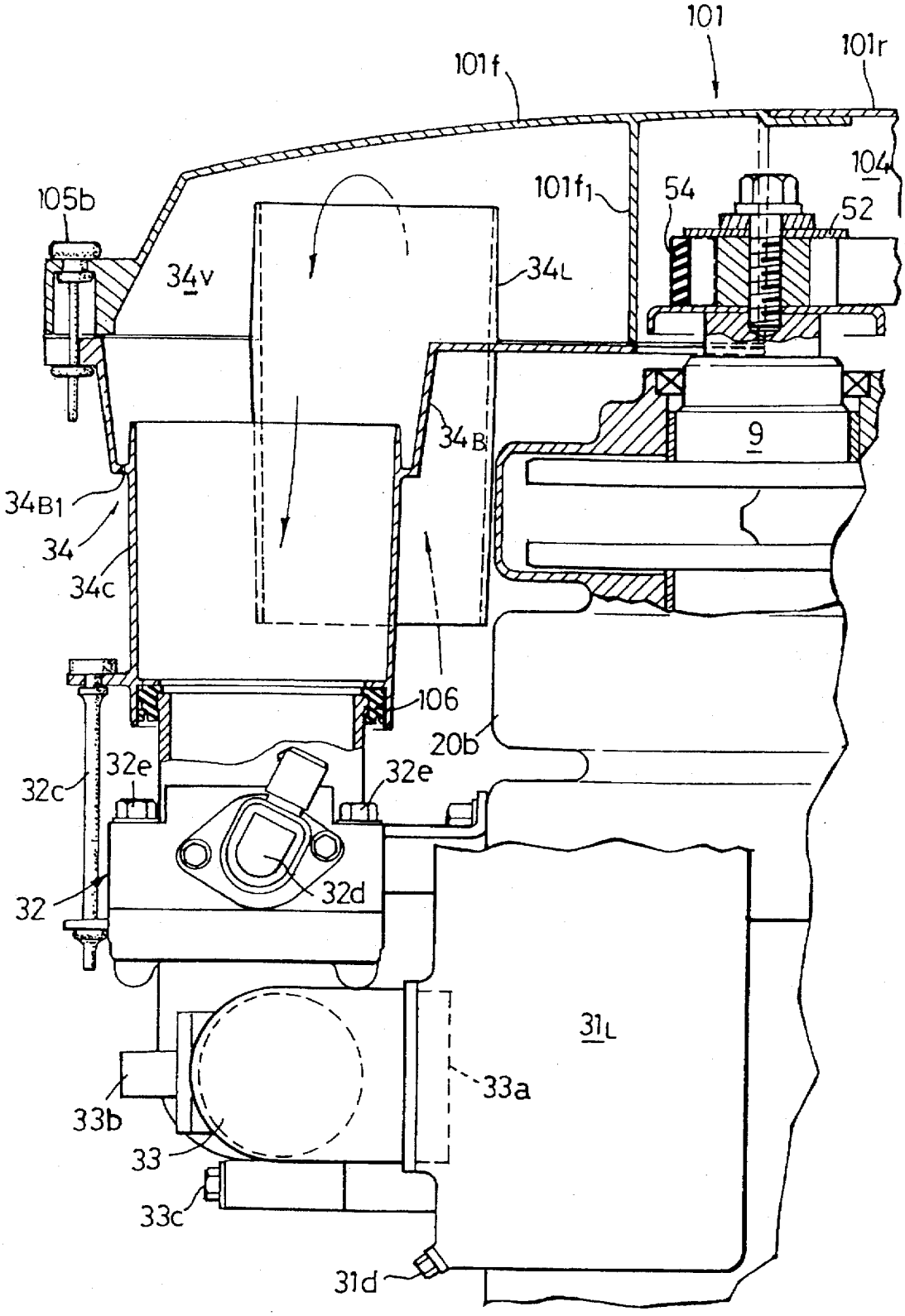
FIG. 8 is an enlarged sectional view taken along the line 8—8 in FIG. 7.

In FIGS. 2 and 8, reference character 32a is a throttle valve shaft, reference character 32b is a link member, and reference character 32c is a fastener made of a rubber or the like, which is mounted between a locking portion, having a small hole, provided on the intake silencer 34 and a locking portion, having a notched fine groove, provided on the air passage 33. In FIG. 3, reference character 32d is a throttle opening degree sensor, and reference character 33b is an intake air temperature sensor. The throttle body 32 and the air passage 33 are coupled to each other by a bolt 32e. The throttle body 32 and the intake silencer 34 are coupled to each other by the fastener 32c. The air passage 33 and the crankcase 20b are coupled to each other by a bolt 33c.

The pair of left and right air passages 33, each having the same length, are connected to the pair of left and right surge tanks 31L and 31R through connections 33a. The volume areas of the surge tanks 31L and 31R extend both higher and lower than the connections 33a as shown in FIG. 2. The volume of the volume area is set as required, but a portion of the volume area, which is located below the connection 33a, is located outside a flow of air from the connection 33a to a connected portion of each intake pipe 30. Therefore, that portion of the volume area also functions as a water-separating chamber when water enters an intake system. Reference character 31d is a drain bolt.

Fuel is supplied from a fuel tank (not shown) mounted on a boat. As shown in FIG. 2, a fuel receiving pipe 37, which is mounted in the outboard engine system, is connected to the fuel tank. The fuel supplied through the fuel receiving pipe 37 is initially stored in vapor-fuel separator 42 while being limited by a float 41, and is then supplied via a strainer 43, a high-pressure pump 44, a high-pressure filter 45 and pipes 38 and 39 to the fuel injecting valves 35. These devices and the pipes in the outboard engine system are disposed on the right side of the engine 7, as shown in FIG. 2. The high-pressure pump 44 may be disposed within or outside the vapor-fuel separator 42.

Figure 6:
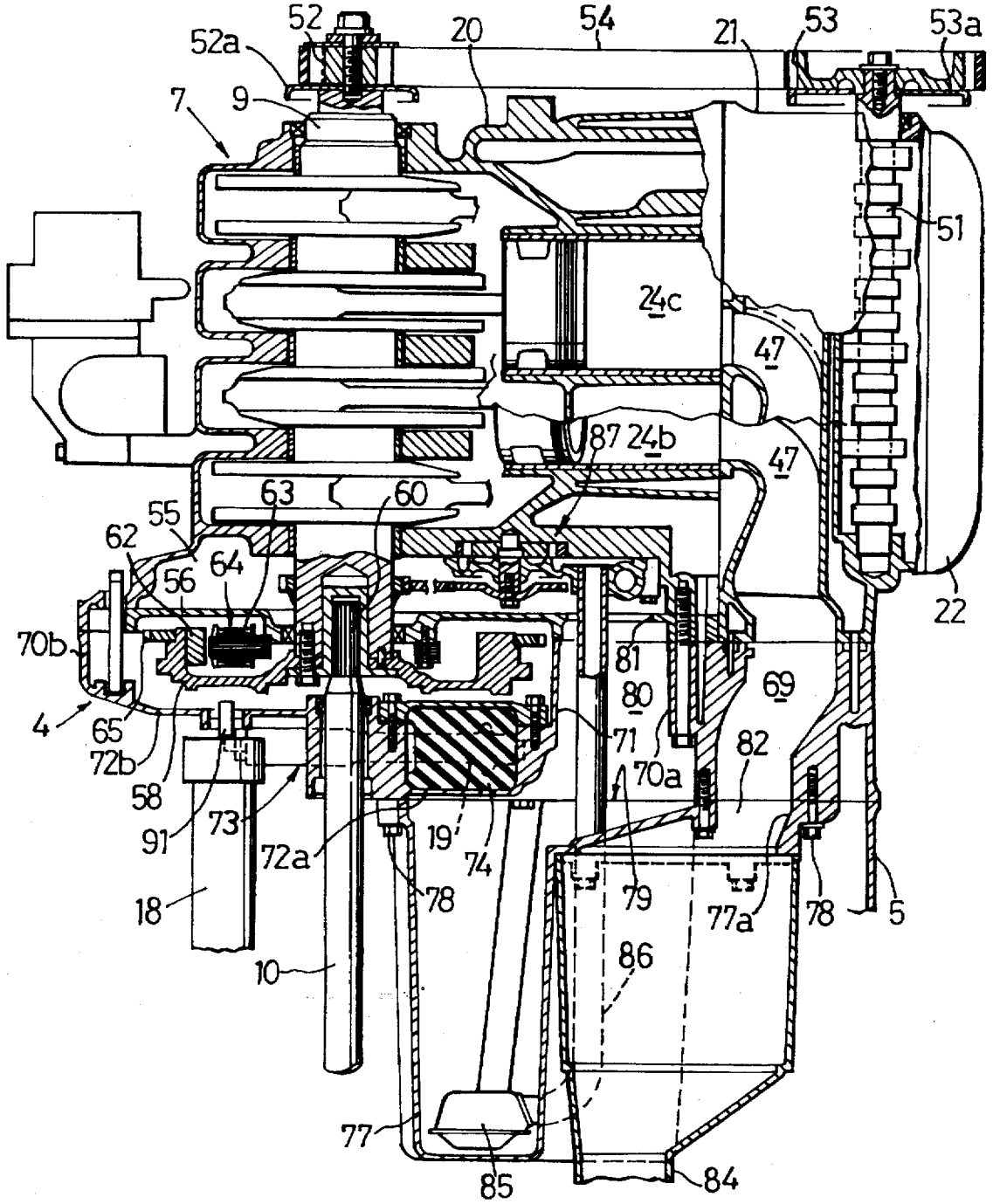
FIG. 6 is a longitudinal sectional view of the engine.

FIG. 6 is a longitudinal sectional view of the engine 7 taken along various sections including an axis of the crankshaft 9, wherein the section of the cylinder 24c and a portion of the section of the cylinder 24b are shown in FIG. 6.

As can be seen from FIGS. 4 and 6, exhaust passages 47L and 47R and an exhaust valve 46 are provided below the intake passage 28 and the intake valve 29 for each of the cylinders 24. The exhaust passages 47R connected to the exhaust valves 46 for the right cylinders 24c and 24d, and the exhaust passages 47L connected to the exhaust valves 46 for the left cylinders 24a and 24b extend downwardly along a widthwise central portion of the cylinder head 21, i.e., between the right cylinders 24c and 24d and the left cylinders 24a and 24b, and join with each other at a lower end and open into a lower surface of the cylinder head 21.

In FIGS. 2 to 4, reference character 36 is an igniter mounted for each of the cylinders 24a, 24b, 24c and 24d. The igniter 36 is composed of an ignition coil 36a, a cap 36b and a spark plug 36c.

As shown in FIG. 3, a starter motor 48 is mounted on the left side of the engine block subassembly 20 such that an output shaft 49 of the starter motor 48 protrudes downwardly. A driving gear 50 is mounted on the output shaft 49. The driving gear 50 is meshed with a ring gear integrally formed around an outer periphery of a flywheel which will be described hereinafter.

As shown in FIG. 6, the crankshaft 9 is vertically directed as described above, and a camshaft 51 is disposed in the cylinder head 21 in parallel to the crankshaft 9. Upper ends of the crankshaft 9 and the camshaft 51 protrude upwardly through the engine block subassembly 20 and the cylinder head 21, respectively. A driving pulley 52 and a follower pulley 53 are fixedly mounted at these upper ends, respectively, and a belt 54 is wound around the pulleys 52 and 53. Thus, the camshaft 51 is driven through the belt 54 by the crankshaft 9. Since the engine 7 is a 4-cycle engine, the diameter of the follower pulley 53 is set at a value twice as large as the diameter of the driving pulley 52 in order to set the rotational ratio of the crankshaft 9 to the camshaft 51 at 2:1. Each of reference characters 52a and 53a is a controlling pick-up plate.

The lower surface of the engine block subassembly 20 has an opened portion 55. A lower wall of the engine block subassembly 20 is formed by a closing plate 56 which closes the opened portion 55 in a sealing manner. The closing plate 56 is detachably secured to the engine block subassembly 20 by bolts 57 (see FIGS. 2 and 3). A lower end of the crankshaft 9 rotatably passes through the closing plate 56 to protrude downwardly. A flywheel 58 is secured to the lower end of the crankshaft 9. A dynamo 64 is mounted inside the flywheel 58, and includes a rotor 62 fixed on the side of the flywheel 58 and a stator 63 fixed on the side of the closing plate 56.

A ring gear 65 is integrally formed around an outer periphery of the flywheel 58 by shrink-fitting or the like. The ring gear 65 is meshed with the driving gear 50 mounted on the output shaft 49 of the starter motor 48 (see FIG. 3) on the left side of the engine block subassembly 20. At the start of the engine, the crankshaft 9 is driven by the starter motor 48.

The engine mount case 4 is clamped and coupled along with the closing plate 56 to a lower surface of the engine block subassembly 20 by the bolts 57 with the closing plate 56 interposed between the engine mount case 4 and the lower surface of the engine block subassembly 20. The engine mount case 4 extends rearwardly, i.e., to the cylinder head 21 and is also coupled to that lower surface of the cylinder head 21 into which the exhaust passages 47L and 47R open.

The engine mount case 4 includes peripheral walls 70a and 70b extending downwardly from connected faces between the engine mount case 4 and the closing plate 56 via packing, and an enclosure wall 71 extends downwardly from the connected faces (see FIG. 6). Both of the peripheral walls 70a and 70b and the enclosure wall 71 extend to locations below the flywheel 58. The flywheel 58 is surrounded by the peripheral wall 70b and the enclosure wall 71. Further, a bottom plate or wall 72a continuously formed with a lower end of the peripheral wall 70a, and a bottom plate or wall 72b continuously formed with the peripheral wall 70b, extend to locations below a central portion of the flywheel 58. The height (i.e., the depth) of the peripheral wall 70b, as measured downwardly from the connected faces, is lower than the height (i.e., depth) of the peripheral wall 70a. Therefore, the bottom plates 72b and 72a superpose with each other at a vertical distance below the central portion of the flywheel 58. A mounting opening 73, which opens forwardly, is formed at the superposed portion.

The driving shaft 10, for transmitting the rotation of the crankshaft 9 to the propeller 13, is pivotally supported at the bottom plate 72*b* and 72*a* and vertically passes through the opening 73. An upper end of the driving shaft 10 is inserted from below into a collar member 60 to spline-engage the latter. The collar member 60 is fitted into the crankshaft 9.

The connecting member 19, for interconnecting the swivel shaft 18 and the engine mount case 4, is also inserted from the front into the opening 73. The connecting member 19 includes two left and right connecting rods 19L and 19R (see FIGS. 2 and 3) extending in a longitudinal direction on opposite sides of the driving shaft 10. Tip ends of the connecting rods 19L and 19R are connected to the engine mount case 4 through a rubber mount 74.

A peripheral edge of an upper end of an oil pan 77 is fastened to the lower surface of the engine mount case 4 by a bolt 78. An opening 79 is provided in an upper surface of the oil pan 77 and communicates with an interior of the engine block subassembly 20 through an oil communication passage 80 formed in the engine mount case 4 and through an opening 81 provided in the closing plate 56, so that oil which is returned from a cam chamber and a crank chamber and accumulated on the closing plate 56 flows through the oil communication passage 80 and is dropped through the opening 79 into the oil pan 77. However, the oil on the closing plate 56 cannot enter a portion of the flywheel 58 which is surrounded by the peripheral wall 70*b* and the enclosure wall 71, because the opening 81 is provided in the enclosure plate 56 on the opposite side from the flywheel 58 with respect to the enclosure wall 71.

A portion of a flange of the oil pan 77 is extended to form an exhaust pipe portion 77*a*. The exhaust pipe portion 77*a* is integrally formed at an upper portion of the oil pan 77 to protrude rearwardly. An exhaust passage 82 is formed in the exhaust pipe portion 77*a* and communicates with the exhaust passage 69 in the engine mount case 4. The exhaust passage 82 communicates with a catalytic converter 83 which is juxtaposed outside the oil pan 77. An exhaust gas purified in the catalytic converter 83 flows through the exhaust pipe 84 and is discharged through a lower portion of the body case 6 into the water. The oil stored in the oil pan 77 is drawn via a strainer 85 and a suction pipe 86 into an oil pump 87 and is supplied to various portions of the engine.

Figure 7:
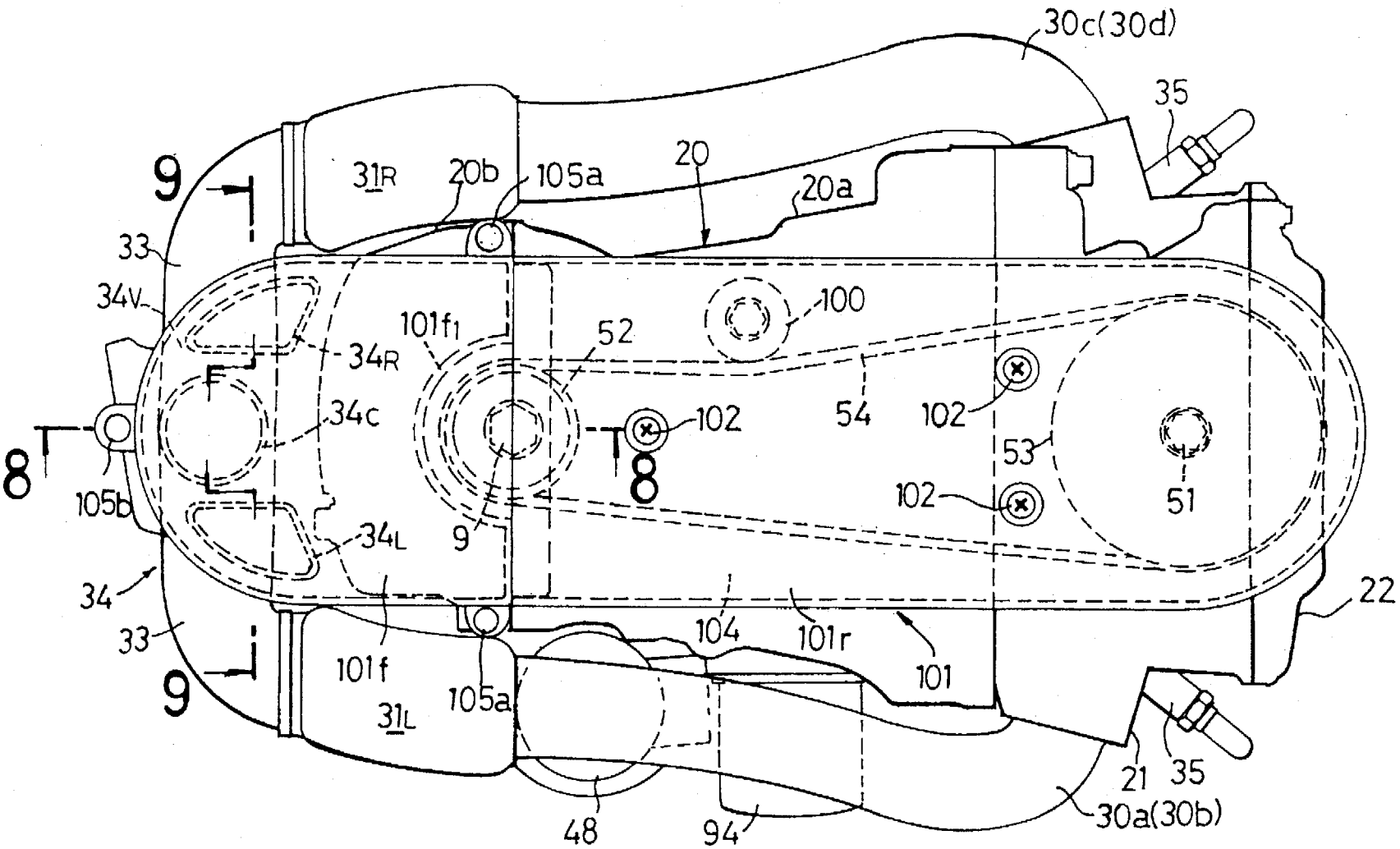
FIG. 7 is a view taken in a direction indicated by 7 in FIG. 3.
Figure 9:
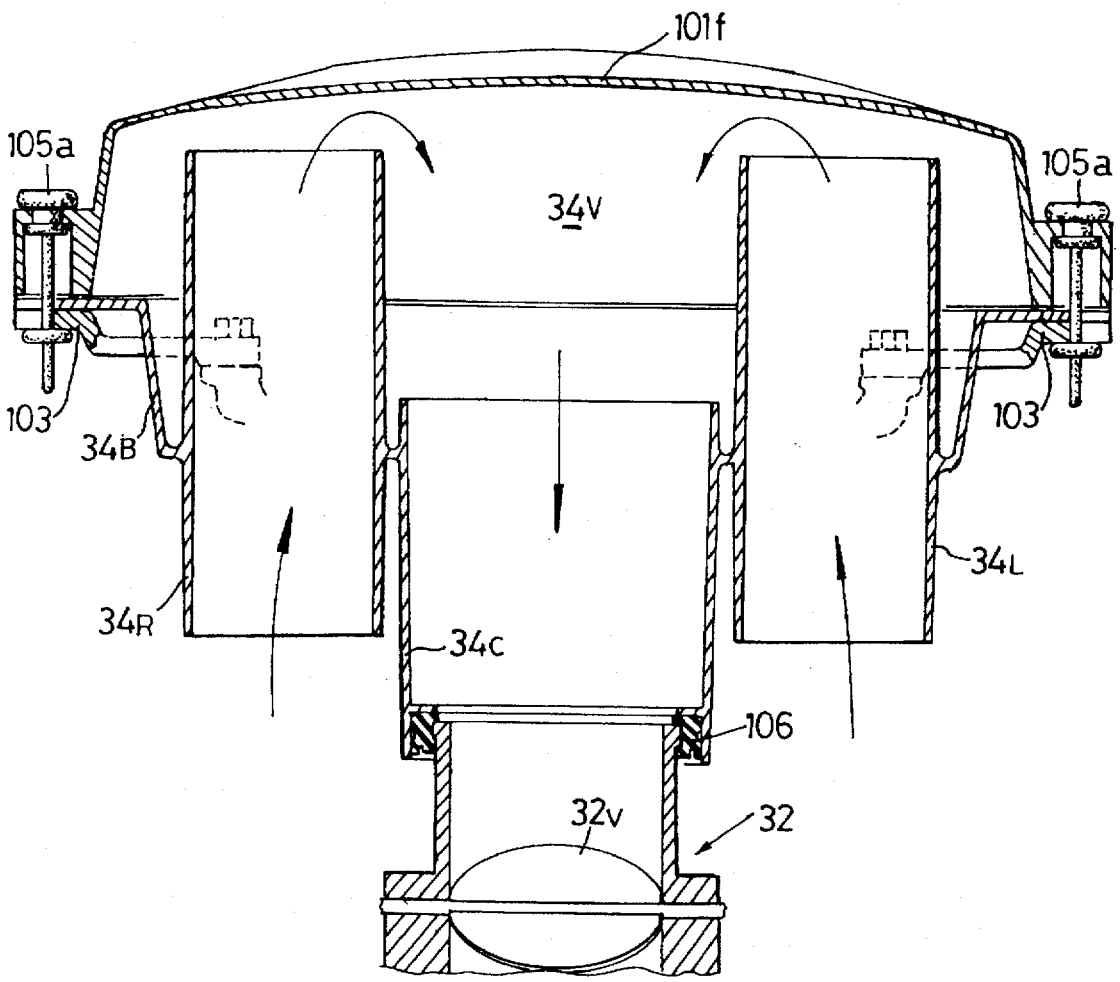
FIG. 9 is an enlarged sectional view taken along the line 9—9 in FIG. 7.

The structures of a belt cover 101 and the intake silencer 34 will be described below with reference to FIGS. 7 to 9.

The belt cover 101, which covers the pair of pulleys 52 and 53, the belt 54 and a tensioner 100, is divided into two portions: (1) a first cover half 101*f* located at a front position and (2) a second cover half 101*r* located at a rear position. The second cover half 101*r* entirely covers the follower pulley 53 and the tensioner 100 and partially covers the belt 54 and the driving pulley 52. The second cover half 101*r* is detachably fixed to a single boss, which is projectingly provided on the upper surface of the engine block subassembly 20, and to two bosses projectingly provided on the upper surface of the cylinder head 21 by three bolts 102.

The first cover half 101*f* partially covers the belt 54 and the driving pulley 52 and is superposed on a lower surface of an end edge of the second cover half 101*r*. A partition wall 101*f*1 is formed on the first cover half 101*f* to surround substantially half of a periphery of the driving pulley 52. A belt chamber 104 in the second cover half 101*r* and the intake silencer chamber 34V of the intake silencer 34 are partitioned from each other by the partition wall 101*f*1.

In this manner, substantially half of the periphery of the driving pulley 52 is surrounded by the partition wall 101*f*1 which partitions the intake silencer chamber 34V and the belt chamber 104 from each other. Therefore, it is possible to increase, to a maximum, the volume of the intake silencer chamber 34V toward the belt chamber 104 and to enhance the silencing effect. In addition, since the belt cover 101 is divided into the first cover half 101*f* and the second cover half 101*r* covering the belt chamber 104, these cover halves 101*f* and 101*r* can separately be removed, which facilitates maintenance work.

The air intake pipes 34L and 34R and the intake-air introducing pipe 34C of the silencer 34 are formed integrally with a lower wall member 34B which is coupled to the first cover half 101*f* to define the intake silencing chamber 34V. Specifically, at the opposite sides of the first cover half 101*f*, the first cover half 101*f* and the lower wall member 34B are fixed to a stay 103, projectingly provided on the engine block subassembly 20, by two fasteners 105*a* made of a rubber or the like. The first cover half 101*f* is fixed at its front portion to the lower wall member 34B by a fastener 105*b* made of a rubber or the like (see FIGS. 8 and 9).

The upper end of the intake-air introducing pipe 34C extends within the intake silencing chamber 34V to pass through the lower wall member 34B upwardly from below. A drain hole 34B1 is formed at a lowermost location in the intake silencing chamber 34V. The lower end of the intake-air introducing pipe 34C is fitted over and supported on the upper end of the throttle body 32 with a seal member 106 interposed therebetween.

Since the intake silencing chamber 34V is fixed by the three fasteners 32*c*, 105*a* and 105*a*, as described above, the intake silencing chamber 34V can easily be removed with a simple operation merely by stretching the fasteners 32*c*, 105*a* and 105*a* to release the engagement of their lower ends. Alternatively, the first cover half 101*f* and the lower wall member 34B of the intake silencer 34 may be integrally connected by bolting or by welding and fixed to the engine block subassembly 20 by the fasteners 32*c*, 105*a* and 105*a*.

The air drawn through the air intake port 8*a* in the engine cover 8 into an engine compartment is passed upwardly through the left and right air intake pipes 34L and 34R, and is expanded and silenced within the intake silencing chamber 34V having a large volume. The air is then passed downwardly from the intake silencing chamber 34V through the intake-air introducing pipe 34C and supplied to the throttle body 32. The air passed through the throttle body 32 is passed via the left and right air passages 33 to the left and right surge tanks 31L and 31R and then supplied via the two left and two right intake pipes 30*a* to 30*d* to the cylinders 24*a* to 24*d*.

The intake noise of the engine 7 of the outboard engine system can be reduced by provision of the intake silencer 34 upstream of the throttle body 32 in the above manner. In addition, since the upper wall of the intake silencing chamber 34V is formed from the first cover half 101*f* of the belt cover 101, not only the number of the parts or components can be decreased, but also a neat appearance can be provided. Further, since the two air intake pipes 34L and 34R are disposed in a divided manner on opposite sides of the intake-air introducing pipe 34C, even if each of the air intake pipes 34L and 34R are small, not only a sufficient total sectional area of flow paths can be assured, but also the throttle body 32 can be disposed on the centerline of the engine 7 to form the left and right intake systems which are substantially symmetrical.

Since the air intake pipes 34L and 34R and the intake-air introducing pipe 34C are integrally formed in the lower wall member 34B, the number of parts or components is decreased. Moreover, since any of the air intake pipes 34L and 34R and the intake-air introducing pipe 34C extend downwardly and in parallel from the intake silencing chamber 34V, the intake silencer 34 can easily be disposed in a compact manner in the narrow engine compartment. Furthermore, it is possible to reliably prevent water from entering through the air intake pipes 34L and 34R into the intake silencing chamber 34V.

Even if water enters the intake silencing chamber 34V through the air intake pipes 34L and 34R, the water is accumulated on the bottom surface of the intake silencing chamber 34V and discharged through the drain hole 34B1. Hence, the water cannot flow through the intake-air introducing pipe 34C into the throttle body 32. The drain hole 34B1 can be normally closed by a drain bolt.

The disposition of an oil filter 94 will be described below with reference to FIGS. 3 and 5.

As shown in FIG. 5, the left cylinders **24*a* and 24*b* are disposed at elevation levels higher than those of the right cylinders 24*c* and 24*d*. Thus, a space is created below the cylinder 24*b*. The oil pump 87 is disposed in this space. As can be seen from FIG. 3, the starter motor 48, the oil filter 94 and the two intake pipes 30*a* and 30*b* are disposed on the left side of the cylinder block 20*a*. The lower intake pipe 30*b* is disposed to traverse between the starter motor 48 and the oil filter 94. The oil filter 94 is disposed in a space defined between the upper and lower intake pipes 30*a* and 30*b***.

As apparent from comparison of FIG. 3 with FIG. 2, the level of the lower intake pipe **30*b* on the left side is at a location higher than that of the lower intake pipe 30*d* on the right side, because the left cylinders 24*a* and 24*b* are disposed at elevation locations higher than those of the right cylinders 24*c* and 24*d*. As a result, the starter motor 48 can be laid-out by utilizing a wasted space defined below the lower intake pipe 30*b* on the left side. The oil filter 94 disposed between the two intake pipes 30*a* and 30*b* is at a location higher in elevation than an upper edge of the under-case portion 6*a* (see FIG. 3). Therefore, the mounting and removal of the oil filter 94 can easily be performed without being impeded by the under-case portion 6*a***.

The pair of left and right air intake pipes 34L and 34R are provided in the embodiment, but the number of the air intake pipes is not limited to two.

The flywheel 58 is mounted at the lower end of the crankshaft 9 in the embodiment, but the flywheel 58 may be mounted at the upper end of the crankshaft 9 above the driving pulley 52 of the crankshaft 9. In this case, attention should be paid so that the upper end of the intake silencer 34 does not interfere with the flywheel 58, but it is possible to assure the volume of the intake silencer 34 by a space corresponding to the height of the belt 54 which is wound around the driving pulley 52 below the flywheel 58.

Independent cylinder heads may be provided in left and right banks of the engine 7, respectively.

Further, each of the fasteners **32*c*, 105*a* and 105*b*** is not limited to those made of the rubber, and may be a coil spring.

Although the embodiment of the present invention has been described in detail, it will be understood that the present invention is not limited to the above-described embodiment, and various modifications in design may be made without departing from the spirit and scope of the invention defined in claims.

What is claimed is:

1. An intake device in an engine for an outboard engine system comprising:

an engine block subassembly for supporting a crankshaft in a vertical attitude, and having a plurality of cylinders formed therein to extend rearwardly from said crankshaft;

a cylinder head coupled to a rear end of said engine block subassembly;

a throttle body disposed in front of said engine block subassembly;

a plurality of intake pipes extending from said throttle body through left and right opposite sides of said engine block subassembly and connected to said cylinder head;

an intake silencer mounted above said throttle body, said intake silencer including an intake-air introducing pipe extending upwardly from said throttle body, an intake silencing chamber into which an upper end of said intake-air introducing pipe opens, and an air intake pipe which opens at an upper end thereof into said intake silencing chamber and extends downwardly from said intake silencing chamber.

2. An intake device in an engine for an outboard engine system according to claim 1, further including a belt cover which covers a driving pulley mounted at an upper end of said crankshaft which protrudes on an upper surface of said engine block subassembly, a follower pulley mounted at an upper end of a cam shaft which protrudes on an upper surface of said cylinder head, and a belt wound around said driving and follower pulleys, and said intake silencing chamber has an upper wall formed by said belt cover.

3. An intake device in an engine for an outboard engine system according to claim 2, wherein said belt cover has an internal space which is divided into said intake silencing chamber and a belt chamber by a partition wall, and a substantially front half of a periphery of said driving pulley is surrounded by said partition wall.

4. An intake device in an engine for an outboard engine system according to claim 3, wherein said belt cover is divided into a first cover half forming said upper wall of said intake silencing chamber, and a second cover half forming an upper wall of said belt chamber.

5. An intake device in an engine for an outboard engine system according to claim 2, wherein said intake-air introducing pipe and said air intake pipe are integrally formed to a lower wall member, said lower wall member is coupled to a lower surface of said belt cover to form a lower wall of said intake silencing chamber.

6. An intake device in an engine for an outboard engine system according to claim 1, wherein an upper end of said intake-air introducing pipe extends higher than a bottom surface of said intake silencing chamber, and said intake silencing chamber is formed at a bottom surface thereof with a drain hole.

7. An intake device in an engine for an outboard engine system according to claim 1, wherein a pair of air intake pipes are provided as said air intake pipe, and wherein said pair of air intake pipes are disposed on left and right opposite sides of said intake-air introducing pipe.

8. An intake device in an engine for an outboard engine system according to claim 1, wherein a first stretchable fastener is stretched between said intake silencer and said throttle body, and a second stretchable fastener is stretched between said intake silencer and said engine block subassembly, wherein said intake silencer is detachably supported on said throttle body and said engine block subassembly.

9. An intake device in an engine for an outboard engine system according to claim 1, further comprising a sealing member interposed between a lower end of the intake-air introducing pipe and an upper end of the throttle body.

10. An intake device in an engine for an outboard engine system according to claim 1, further including a cover which covers a upper surface of said engine block subassembly, said intake silencing chamber has an upper wall formed by said cover.

11. An intake device in an engine for an outboard engine system according to claim 10, wherein said cover is divided into a first cover half forming said upper wall of said intake silencing chamber, and a second cover half.

12. An intake device in an engine for an outboard engine system according to claim 10, wherein said intake-air introducing pipe and said air intake pipe are integrally formed to a lower wall member, said lower wall member is coupled to a lower surface of said cover to form a lower wall of said intake silencing chamber.

13. An intake device in an engine for an outboard engine system according to claim 11, wherein said first cover half is superposed on a lower surface of an end edge of the second cover half.

14. An intake device in an engine for an outboard engine system according to claim 4, wherein said first cover half is superposed on a lower surface of an end edge of the second cover half.

* * * * *